US005372069A

United States Patent [19]

Hart et al.

[11] Patent Number: 5,372,069

[45] Date of Patent: Dec. 13, 1994

[54] PYRONOL TORCH

[75] Inventors: George L. Hart, Yuma, Ariz.; Edwin L. McCluer, Palms, Calif.; Alexander G. Rozner, Potomac, Md.; William R. Walton, Clarksville, Md.; James C. Waldron, Silver Spring, Md.

[73] Assignee: The United States of America as represented by the Secretary of the Navy, Washington, D.C.

[21] Appl. No.: 118,349

[22] Filed: Sep. 9, 1993

[51] Int. Cl.[5] ..... C06B 33/00

[52] U.S. Cl. ..... 102/288; 102/289; 149/37

[58] Field of Search ..... 102/286, 288, 289; 149/37

[56] References Cited

U.S. PATENT DOCUMENTS

| | | | |
|---|---|---|---|
| 3,503,814 | 3/1970 | Helms, Jr. et al. | 149/37 |
| 4,280,409 | 7/1981 | Rozner et al. | 102/364 |
| 4,372,213 | 2/1983 | Rozner et al. | 102/301 |
| 4,374,686 | 2/1983 | Davitt et al. | 149/21 |
| 4,424,086 | 1/1984 | Christopher | 149/19.3 |
| 4,495,848 | 1/1985 | Rozner et al. | 89/1.1 |

*Primary Examiner*—Peter A. Nelson
*Attorney, Agent, or Firm*—Roger D. Johnson

[57] ABSTRACT

A pyrotechnic, molten metal jet torch which employs a loose pyrotechnic starter powder such as (1) magnesium powder, or an intimate mixture of (2) Mg and CuO, (3) Mg and $Fe_2O_3$, (4) Mg and $Co_3O_4$, (5) Al and CuO, or (6) Al and $Fe_2O_3$ powders which are capable of being ignited by a conventional military incendiary grenade fuse and which generated enough heat to ignite pyronol pellets which are pressed from an intimate powder mixture of (1) nickel, (2) metal oxide, (3) a component selected from the group consisting of (a) aluminum and (b) a mixture of at least 50 weight percent aluminum and a metal that is magnesium, zirconium, bismuth, beryllium, boron, or mixtures thereof.

19 Claims, 1 Drawing Sheet

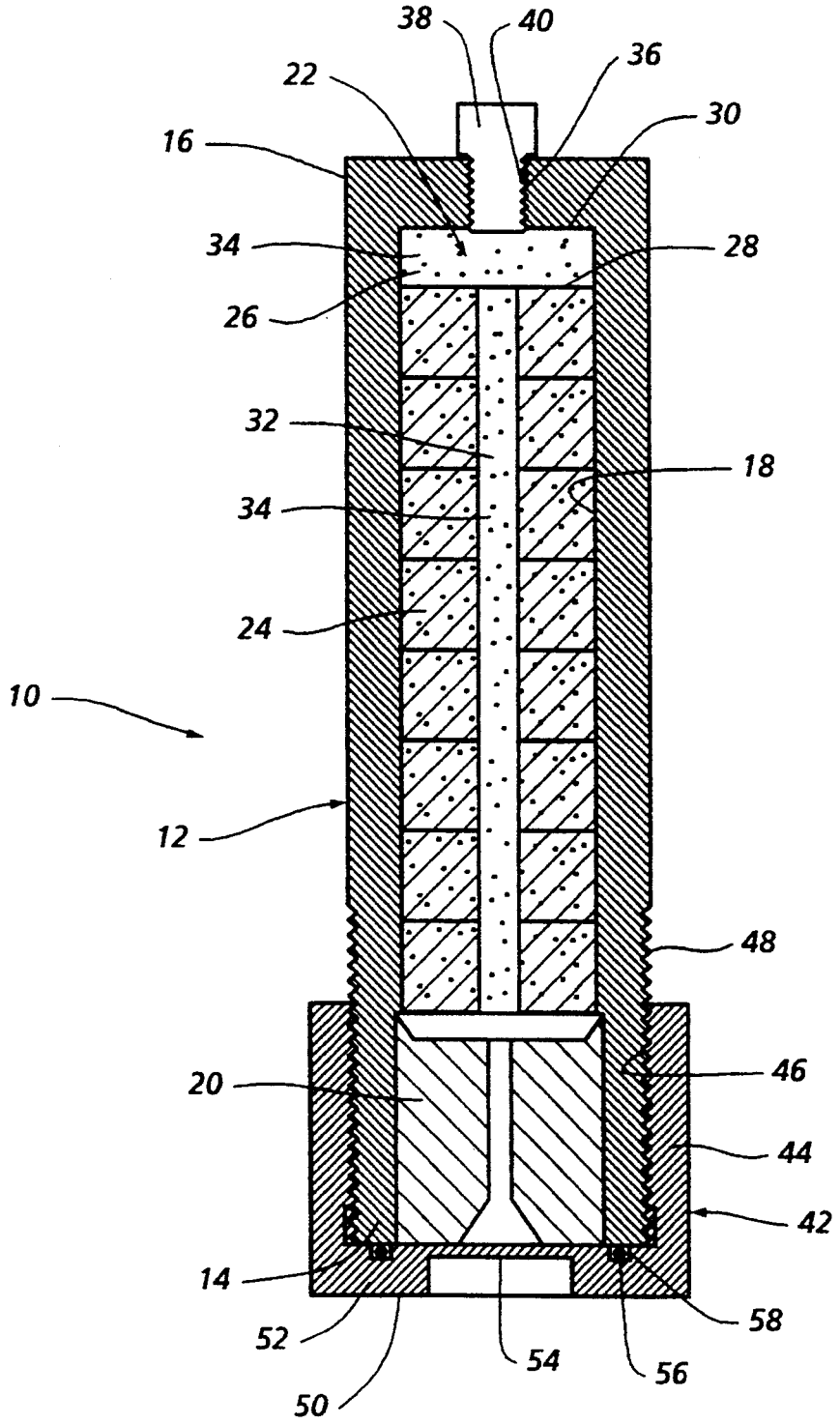
38
40
36
22
30
16
34
28
26
32
18
34
24
10
12
48
20
46
44
42
14
58
52
54
56
50

PYRONOL TORCH

BACKGROUND OF THE INVENTION

This invention relates to pyrotechnic devices and more particularly to pyrotechnic devices for producing molten metal jets.

Pyronol torches produce high velocity and high pressure jets of molten metal which easily cut through the toughest steels or metal composite materials. These torches are used to cut through locks, cables, reinforcement bars, metal grills, armor plates, etc. A serious disadvantage of the conventional pyronol torches is that an electrical initiator must be used with them. This means that a battery, switching device, and cables are needed and must be carried along with the torch. Use of the pyronol torch is slowed down by the need to connect the battery and cables to the torch at the time of use. Moreover, the use of an electrical initiator is hazardous in a high electromagnetic field environment such as a radio transmitter, air field, or communication cable network.

It would be desirable therefore to provide a pyronol torch that would be quicker, easier, and safer to use.

SUMMARY OF THE INVENTION

According, an object of this invention is to provide a new pyrotechnic, molten metal jet torch.

Another object of this invention is to provide a new pyrotechnic, molten jet torch that has a nonelectrical initiator.

A further object of this invention is to provide a new pyrotechnic, molten metal jet torch that is quicker, easier, and safer to use.

This and other objects of this invention are accomplished by providing: a pyrotechnic, molten metal jet torch which employs a loose pyrotechnic starter powder such as (1) magnesium powder, or an intimate mixture of (2) Mg and CuO, (3) Mg and $Fe_2O_3$, (4) Mg and $Co_3O_4$, (5) Al and CuO, or (6) Al and $Fe_2O_3$ powders which are capable of being ignited by a conventional military incendiary grenade fuse and which generated enough heat to ignite pyronol pellets which are pressed from an intimate powder mixture of (1) nickel, (2) metal oxide, (3) a component selected from the group consisting of (a) aluminum and (b) a mixture of at least 50 weight percent aluminum and a metal that is magnesium, zirconium, bismuth, beryllium, boron, or mixtures thereof.

BRIEF DESCRIPTION OF THE DRAWING

A more complete appreciation of the invention and many of the attendant advantages thereof will be readily appreciated as the same becomes better understood by reference to the following detailed description when considered in connection with the accompanying drawing which is a cross-sectional side view of the incendiary torch of the present invention.

DETAILED DESCRIPTION OF THE PREFERRED EMBODIMENT

Referring to the drawing there is shown an incendiary or pyrotechnic torch 10 which includes a cylindrical housing 12 having an open end 14, a substantially closed end 16, and a cylindrical bore 18 along the length thereof. A graphite nozzle 20 substantially closes of the open end 14 of housing 12 to form a cylindrical chamber 22 in the cylindrical bore 18.

The chamber 22 is filled with conventional pyronol type fuel in the form of a plurality of cylindrical pellets 24 the composition of which will be discussed in greater detail hereafter. A space 26 is left between the top surface 28 of the conventional fuel pellets 24 and the inner surface 30 of the closed end 16 in the chamber 22. The conventional fuel pellets 24 have a central bore 32 formed therein and upon stacking the pellets in the chamber 22 bores 32 are aligned thereby forming a single elongated bore which extends from the space 26 at the closed end 16 of the housing 12 to the graphite nozzle 20. The space 26 and the elongated bore 32 are filled with a lower ignition temperature pyrotechnic starter fuel 34 which is in the form of a powder. The composition of the pyrotechnic starter fuel 34 is critical to this invention and will be discussed in detail below.

The closed end 16 of the housing 12 has a threaded bore 36 formed centrally therein which is adapted to threadably receive a standard military incendiary grenade fuse 38 having standard military threads 40 on the outside thereof. Screwing the incendiary grenade fuse 38 into the threaded bore 36 arms the torch 10. The incendiary grenade fuse 38 is positioned to discharge its stream of hot particles into the powdered pyrotechnic starter fuel 34 in the space 26 in the chamber 22.

Looking again at the open end 14, the graphite nozzle 20 is fitted into the open end 14 of housing 12 and fits within the chamber 22. The nozzle 20 is retained in this position by a cylindrical retaining cap 42. The retaining cap 42 has a cylindrical wall portion 44 which has a threaded inner surface 46 which is adapted to be threadably engageable with an external thread 48 which extends for a short distance from the open end on the outside of the housing 12. The circular bottom portion 50 of the retaining cap 42 is made up of a thick annular outer portion 52 and circular inner portion that is a relatively thin diaphragm 54 designed to rupture and release the molten metal jet when a predetermined upper limit of pressure is achieved in the chamber 22. The thick annular portion 52 supports and retains the nozzle 20 in the chamber 22. A rubber o-ring 56 is fitted into a small annular groove 58 in the thick annular portion 52 to provide a good seal between the retaining cap 42 and the open end 14 of the housing 12.

The fuel pellets 24 used in the torch 10 according to this invention include the convention pyronol formulations disclosed in U.S. Pat. No. 3,695,951, titled "Pyrotechnic Composition," which issued on Oct. 3, 1972 to Horace H. Helms, Jr. and Alexander G. Rozner, herein incorporated by reference in its entirety. The compositions are typically composed of (1) nickel, (2) a metal oxide (such as $Fe_2O_3$, $Fe_3O_4$, $Cr_2O_3$, etc.), (3) aluminum or a mixture of aluminum and magnesium, zirconium, bismuth, beryllium, boron, or mixtures thereof, and (4) Teflon (polytetrafluoroethylene) as a gas source. Mixture of powders of these ingredients are pressed into the pellets 24 using standard powder metallurgy techniques.

Conventionally, powder mixtures of the same compositions as the pellets are used with an electrical ignition system to initiate the torch. However, when the electrical system was replaced with a conventional M201 incendiary grenade fuse, the stream of hot particles generated by the grenade fuse failed to ignite these conventional pyrotechnic powders and initiate the torch.

In the present invention, a special pyrotechnic starter fuel powder 34 replaces the conventional pyrotechnic powder. The starter fuel powder (1) is ignited by conventional military pyrotechnic grenade fuses, (2) generates enough heat and temperature to ignite the conventional pyronol pellets 24, (3) rapidly ignites throughout the torch so that all pyronol pellets are ignited at substantially the same time, and (4) produces molten metal or metal oxide reaction products that contribute to the cutting power of the molten metal jet of the torch. Pyrotechnic starter fuel powders that can be used in this invention preferably include magnesium metal powder and intimate mixtures of a metal such as aluminum (Al) or magnesium (Mg) and a metal oxide such as CuO, $Fe_2O_3$, or $Co_3O_4$. Preferred metal-metal oxide mixtures include (1) Mg and CuO, (2) Mg and $Fe_2O_3$, (3) Mg and $Co_3O_4$, (4) Al and CuO, or (5) Al and $Fe_2O_3$ powders. Preferably from about 0.80 to about 1.25, more preferably from 0.91 to 1.10, and most preferably about 1.0 times the stoichiometric amount of the metal (Al, Mg, or mixtures thereof) is used in the metal-metal oxide mixture. The stoichiometric ratios are calculated based on the following reactions:

(1) $Mg+CuO \rightarrow MgO+Cu+\Delta H_1$ (2) $3Mg+Fe_2O_3 \rightarrow 3MgO+2Fe+\Delta H_2$ (3) $4Mg+Co_3O_4 \rightarrow 4MgO+3Co+\Delta H_3$ (4) $2Al+3\ CuO \rightarrow Al_2O_3+3Cu+\Delta H_4$ (5) $2Al+Fe_2O_3 \rightarrow Al_2O_3+2Fe+\Delta H_5$ (wherein $\Delta H$'s are the heats of formation.) The reactant powders are intimately mixed. The particle sizes of the starter fuel powder ingredients are preferably less than 200 microns and more preferably less than 100 microns.

Referring again to the figure, incendiary grenade fuse 38 is initiated and sends a stream of hot particles into the pyrotechnic starter fuel 34 in space 26 igniting the fuel. The exothermic reaction rapidly spreads through the pyrotechnic starter fuel 34 in the space 26 and the bore hole 32. This in turn ignites the conventional pyrotechnic fuel pellets 24, generating heat, molten metals and metal oxides, and also gas from the decomposition of the teflon in the fuel pellets 24. The pressure in chamber 22 and graphite nozzle 20 increases until the thin metal diaphragm 54 ruptures and the molten reaction products of the fuels are expelled from the chamber 22 through the graphite nozzle 20 in a molten jet or stream.

Obviously, numerous other modifications and variations of the present invention are possible in light of the foregoing teachings. It is therefore to be understood that within the scope of the appended claims the invention may be practiced otherwise than as specifically described.

What is claimed is:

1. An incendiary cutting torch comprising:

A. a cylindrical housing having an elongate cylindrical bore formed the length thereof defining a fuel receiving chamber and having an open end and a closed end;

B. a nozzle detachably connected to said open end of said housing and having at least one aperture their in;

C. a retaining member connected to said open end of said housing having means to receive said nozzle and hold it in position and a bottom portion integral therewith effectively closing said open end;

D. a diaphragm integral within said retaining member adapted to withstand a predetermined internal pressure within said fuel receiving chamber;

E. a first fuel component in the form of a stack of cylindrical pellets each having a bore hole in its center and aligned such that an elongated bore hole runs through the center of the pellet stack for its entire length, said stack leaving a space in the fuel receiving chamber at the closed end away from the nozzle, wherein said first fuel component pellets are pressed from an intimate powder mixture of (1) nickel, (2) metal oxide, (3) a component selected from the group consisting of (a) aluminum and (b) a mixture of at least 50 weight percent aluminum and a metal selected from the group consisting of magnesium, zirconium, bismuth, beryllium, boron, and mixtures thereof, and (4) solid material which will decompose to form a gas when exposed to the heat of the reacting fuels;

F. a second fuel component in the form of a loose powder which fills the bore hole in the stack of first fuel component pellets and fills the space left between the stack and the closed end of the fuel receiving chamber, wherein the second fuel component is (1) Mg powder, (2) an intimate mixture of Mg and CuO powders, (3) an intimate mixture of Mg and $Fe_2O_3$ powders, (4) an intimate mixture of Mg and $Co_3O_4$ powders, (5) an intimate mixture of Al and CuO powders, (6) an intimate mixture of Al and $Fe_2O_3$ powders, (7) mixtures thereof, wherein from about 0.80 to about 1.25 times the stoichiometric amount of Mg is used for mixtures (2), (3), and (4), and wherein from about 0.80 to about 1.25 times the stoichiometric amount of Al is used for mixtures (5) and (6); and G. means by which a standard military incendiary grenade fuse may be inserted into the closed end of the reaction chamber such that the grenade fuse is positioned to ignite the second fuel component powder filling the space at the closed end of the fuel receiving chamber.

2. The torch of claim 1 wherein for the second fuel component mixtures (2), (3), and (4) from 0.91 to 1.10 times the stoichiometric amount of Mg is used and wherein for the second fuel component mixtures (5) and (6) from 0.91 to 1.10 times the stoichiometric amount of Al is used.

3. The torch of claim 2 wherein for the second fuel component mixtures (2), (3), and (4) about 1.0 times the stoichiometric amount of Mg is used and for the second fuel component mixtures (5) and (6) about 1.0 times the stoichiometric amount of Al is used.

4. The torch of claim 1 wherein the second fuel component is (1) Mg powder, (2) an intimate mixture of Mg and CuO powders, (3) an intimate mixture of Mg and $Fe_2O_3$ powders, (4) an intimate mixture of Mg and $Co_3O_4$ powders, or (5) mixtures thereof.

5. The torch of claim 1 wherein the second fuel component is Mg powder.

6. The torch of claim 1 wherein the second fuel component is an intimate mixture of Mg and CuO powders.

7. The torch of claim 1 wherein the second fuel component is an intimate mixture of Mg and $Fe_2O_3$ powders.

8. The torch of claim 1 wherein the second fuel component is an intimate mixture of Mg and $Co_3O_4$ powders.

9. The torch of claim 1 wherein the second fuel component is an intimate mixture of Al and CuO powders.

10. The torch of claim 1 wherein the second fuel component is an intimate mixture of Al and $Fe_2O_3$ powders.

11. In a pyrotechnic molten metal jet cutting torch that uses a conventional pyrotechnic fuel that comprises a powder mixture of (1) nickel, (2) metal oxide, (3) a component selected from the group consisting of (a) aluminum or (b) a mixture of at least 50 weight percent aluminum and a metal selected from the group consisting of magnesium, zirconium, bismuth, beryllium, boron, and mixture thereof, and (4) a solid which decomposes to form a gas from the heat of the alloying and oxidizing reaction, wherein pyrotechnic fuel is mostly in the form of pellets compressed from the loose powder, a lesser part being in the form of a loose powder mixture in contact with the fuel pellets, and wherein an electric igniter system is used to initiate the reaction in the loose fuel powder which in turn initiates the reaction in the pellets, The improvements comprising (1) replacing the electrical igniter system with a standard military incendiary grenade fuse; and (2) replacing the loose powder portion of the conventional pyrotechnic fuel with a loose powder starter pyrotechnic fuel comprising (a) magnesium powder, (b) an intimate mixture of Mg and CuO powders, (c) an intimate mixture of Mg and $Fe_2O_3$ powders, (d) an intimate mixture of Mg and $Co_3O_4$ powders, (e) an intimate mixture of Al and CuO powders, or (f) an intimate mixture of Al and $Fe_2O_3$ powders, or (g) mixtures thereof, wherein from about 0.80 to about 1.25 times the stoichiometric amount of Mg is used for mixtures (b), (c), and (d), and wherein from about 0.80 to about 1.25 times the stoichiometric amount of Al is used for mixtures (e), and (f).

12. The torch of claim 11 wherein for the starter pyrotechnic fuel mixtures (b), (c), and (d) from 0.91 to 1.10 times the stoichiometric amount of Mg is used and wherein for the starter pyrotechnic fuel mixtures (e) and (f) from 0.91 to 1.10 times the stoichiometric amount of Al is used.

13. The torch of claim 12 wherein for the starter pyrotechnic fuel mixtures (b), (c), and (4) about 1.0 times the stoichiometric amount of Mg is used and for the starter pyrotechnic fuel mixtures (e) and (f) about 1.0 times the stoichiometric amount of Al is used.

14. The torch of claim 11 wherein the loose powder starter pyrotechnic fuel is Mg powder.

15. The torch of claim 11 wherein the loose powder starter pyrotechnic fuel is an intimate mixture of Mg and CuO powders.

16. The torch of claim 11 wherein the loose powder starter pyrotechnic fuel is an intimate mixture of Mg and $Fe_2O_3$ powders.

17. The torch of claim 11 wherein the loose powder starter pyrotechnic fuel is an intimate mixture of Mg and $Co_3O_4$ powders.

18. The torch of claim 11 wherein the loose powder starter pyrotechnic fuel is an intimate mixture of Al and CuO powders.

19. The torch of claim 11 wherein the loose powder starter pyrotechnic fuel is an intimate mixture of Al and $Fe_2O_3$ powders.

* * * * *